US008152940B2

(12) United States Patent
Nakai et al.

(10) Patent No.: US 8,152,940 B2
(45) Date of Patent: Apr. 10, 2012

(54) ALUMINUM ALLOY FORGING MEMBER AND PROCESS FOR PRODUCING THE SAME

(75) Inventors: Manabu Nakai, Kobe (JP); Yoshiya Inagaki, Inabe (JP); Atsumi Fukuda, Inabe (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 12/279,189

(22) PCT Filed: Mar. 23, 2007

(86) PCT No.: PCT/JP2007/056024

§ 371 (c)(1),
(2), (4) Date: Aug. 13, 2008

(87) PCT Pub. No.: WO2007/114078

PCT Pub. Date: Oct. 11, 2007

(65) Prior Publication Data

US 2009/0000705 A1 Jan. 1, 2009

(30) Foreign Application Priority Data

Mar. 31, 2006 (JP) ..... 2006-098642
Dec. 8, 2006 (JP) ..... 2006-332194

(51) Int. Cl.
*C22C 21/08* (2006.01)
*C22F 1/05* (2006.01)

(52) U.S. Cl. ..... 148/417; 148/694; 420/535

(58) Field of Classification Search ..... 148/417, 148/693, 694; 420/535, 544
See application file for complete search history.

(56) References Cited

U.S. PATENT DOCUMENTS 6,630,037 B1 10/2003 Sawada et al.

FOREIGN PATENT DOCUMENTS

| | | |
|---|---|---|
| EP | 0 987 344 A1 | 3/2000 |
| GB | 1 344 248 | 1/1974 |
| JP | 5 247574 | 9/1993 |
| JP | 6 256880 | 9/1994 |
| JP | 7 145440 | 6/1995 |
| JP | 9-249951 | 9/1997 |

(Continued)

*Primary Examiner* — Roy King
*Assistant Examiner* — Janelle Morillo
(74) *Attorney, Agent, or Firm* — Oblon, Spivak, McClelland, Maier & Neustadt, L.L.P.

(57) ABSTRACT

The present invention provides an aluminum alloy forging material having enhanced strength, toughness, and corrosion resistance, and a method of producing the material. An aluminum alloy forging material 1 produced with specified components under specified conditions has an arm portion 2 including a relatively narrow and thick peripheral rib 3 and a thin and relatively wide central web 4 having a thickness of 10 mm or less and having a substantially H-shaped sectional form. In a width-direction section of a maximum stress producing site of the rib 3*a*, the density of crystals observed in the structure of a sectional portion 7 where the maximum stress is produced, the spacing of grain boundary precipitates and the size and density of dispersed particles observed in the structure of a sectional portion 8 including a parting line, the recrystallization ratio observed in each of the sectional portions 7 and 8 of the rib, and the recrystallization ratio observed in a sectional portion 9 of the web 4*a* adjacent to the sectional structure of the rib 3*a* in the width direction are defined for enhancing the strength, toughness, and corrosion resistance of the aluminum alloy forging material.

19 Claims, 1 Drawing Sheet

FOREIGN PATENT DOCUMENTS

| | | | | |
|---|---|---|---|---|
| JP | 2000 144296 | | | 5/2000 |
| JP | 2001 73056 | | | 3/2001 |
| JP | 2001 107168 | | | 4/2001 |
| JP | 2002 294382 | | | 10/2002 |
| JP | 2002 348630 | | | 12/2002 |
| JP | 2003 277869 | | | 10/2003 |
| JP | 2004 43907 | | | 2/2004 |
| JP | 2004 84058 | | | 3/2004 |
| JP | 2004084058 | A | * | 3/2004 |
| JP | 2004 292892 | | | 10/2004 |
| JP | 2004 292937 | | | 10/2004 |
| JP | 2006 83437 | | | 3/2006 |

* cited by examiner (a)
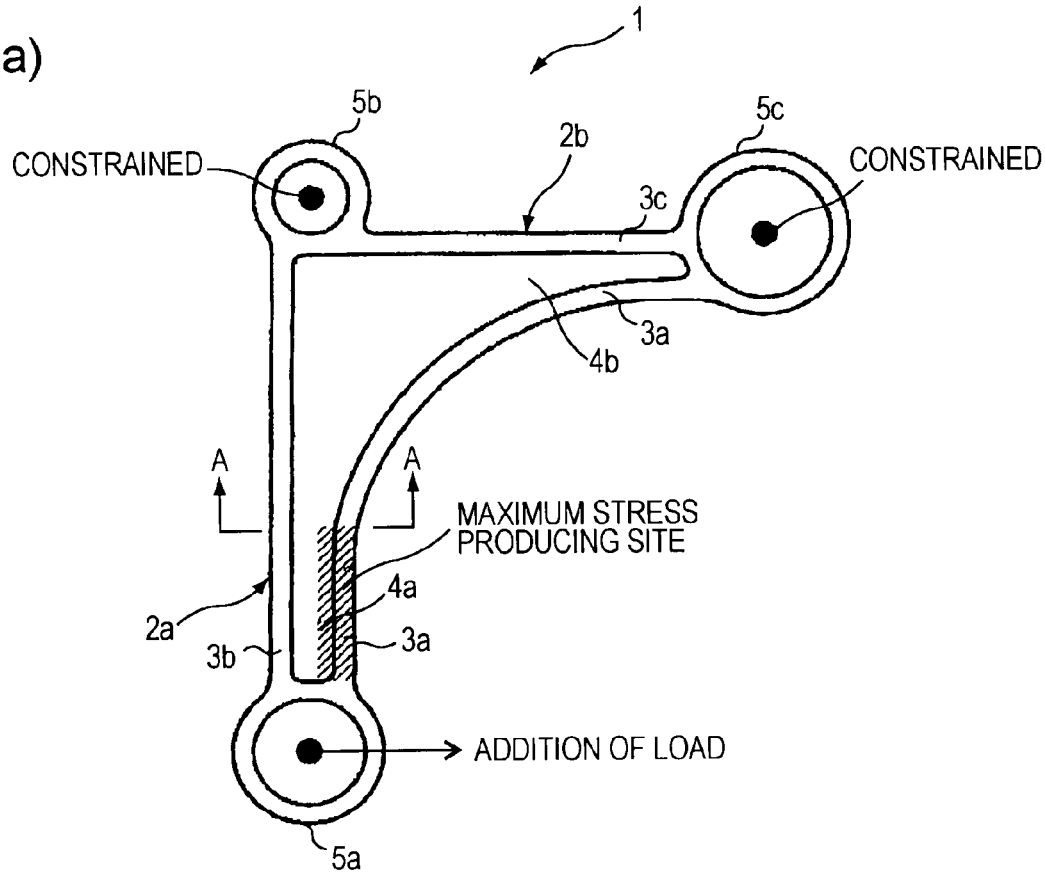
(b)
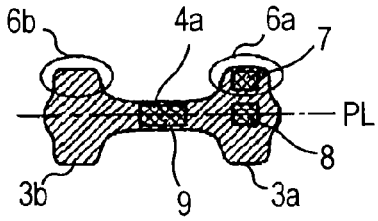

ALUMINUM ALLOY FORGING MEMBER AND PROCESS FOR PRODUCING THE SAME

TECHNICAL FIELD

The present invention relates to an aluminum alloy forging material used for automotive underbody parts and having high strength, high toughness, and excellent corrosion resistance such as stress corrosion cracking resistance and a method for producing the material (hereinafter aluminum is simply referred to as "Al").

BACKGROUND ART

In recent years, in view of global environment problems due to exhaust gases, improvement in fuel consumption has been searched by lightening the body weights of transports such as automobiles. In particular, therefore, Al alloy forging materials of AA or JIS standard 6000 series (Al—Mg—Si) are used as structural materials or structural members of transports such as automobiles, particularly underbody parts such as upper arms and lower arms. Such 6000 series Al alloy forging materials have high strength, high toughness, and relatively excellent corrosion resistance. Also 6000 series Al alloy forging materials have excellent recycleability because of low alloy element contents and easy reusability of scraps as 6000 series Al alloy melting raw materials.

The 6000 series Al alloy forging materials are produced by homogenizing heat-treatment of an Al alloy cast material, hot-forging (die forging) such as mechanical forging or hydraulic forging, solution treatment, and then tempering including hardening and artificial aging. As forging materials, besides the cast material, extruded materials formed by extruding cast materials may be used.

Further, materials which realize high strength, high toughness, and high corrosion resistance are required for underbody parts such as suspensions. From this viewpoint, aluminum alloy forging materials have excellent strength and high reliability as compared with aluminum alloy cast materials.

In recent years, structural materials of such transports have been required to be further thinned and have higher strength and higher toughness in order to further lighten the weights of automobiles. Therefore, there are various attempts to improve the microstructures of Al alloy cast materials and Al alloy forging materials. For example, it has been proposed that the average grain size of crystals and precipitates of a 6000 series alloy cast material is decreased to 8 μm or less, and dendrite secondary arm spacing (DAS) is decreased to 40 μm or less in order to further improve the strength and toughness of an Al alloy forging material (refer to Patent Documents 1 and 2).

Also it has been proposed to further improve the strength and toughness of an Al alloy forging material by controlling the average grain size and average spacing of crystals and precipitates in crystal grains and on grain boundaries of a 6000 series Al alloy forging material. The control can improve corrosion resistance to intergranular corrosion and stress corrosion cracking. Further, it has been proposed to improve fracture toughness and fatigue properties by adding a transition element such as Mn, Zr, Cr, or the like, which has the effect of refining crystal grains, in order to refine crystal grains or make subcrystal grains in addition to the control of crystals and precipitates (refer to Patent Documents 3, 4, and 5).

However, such a 6000 series Al alloy forging material has the tendency to produce course crystal grains by recrystallization of a worked structure during the forging and solution treatment. When the coarse crystal grains are produced, high strength and high toughness cannot be achieved even by controlling the microstructure, and the corrosion resistance is decreased. In addition, in each of these patent documents, the forging work temperature is as relatively low as less than 450° C., and it is actually difficult to refine the intended crystal grains or form subcrystal grains by hot-forging at such a low temperature.

On the other hand, it has been known that in order to suppress the occurrence of coarse crystal grains due to recrystallization of the worked structure, a transition element having the effect of refining crystal grains, such as Mn, Zr, Cr, or the like is added, and hot-forging is started at a relatively high temperature of 450 to 570° C. (refer to Patent Documents 6, 7, and 8 to 10).

[Patent Document 1] Japanese Unexamined Patent Application Publication No. 07-145440

[Patent Document 2] Japanese Unexamined Patent Application Publication No. 06-256880

[Patent Document 3] Japanese Unexamined Patent Application Publication No. 2000-144296 (Registration No. 3684313)

[Patent Document 4] Japanese Unexamined Patent Application Publication No. 2001-107168

[Patent Document 5] Japanese Unexamined Patent Application Publication No. 2002-294382

[Patent Document 6] Japanese Unexamined Patent Application Publication No. 5-247574

[Patent Document 7] Japanese Unexamined Patent Application Publication No. 2002-348630

[Patent Document 8] Japanese Unexamined Patent Application Publication No. 2004-43907

[Patent Document 9] Japanese Unexamined Patent Application Publication No. 2004-292937

[Patent Document 10] Japanese Unexamined Patent Application Publication No. 2004-292892

DISCLOSURE OF INVENTION

Problems to be Solved by the Invention

An automotive underbody part such as a suspension arm includes an arm portion and a ball joint portion provided at an end of the arm portion. In order to lighten the weight of such an automotive underbody part while achieving predetermined strength, particularly the arm portion generally has a substantially H-shaped sectional form including a relatively narrow and thick peripheral rib and a relatively thin central web.

As described above, in order to further thin and lighten the weight of an automotive underbody part while maintaining toughness for further lightening the weight of an automobile, it is necessary to form a shape (hereinafter referred to as a "lighter-weight shape") in which the web is further thinned and, if required, widened, and the rib is further narrowed and thickened. Therefore, an automotive underbody part having a thin arm with a web thickness of 10 mm or less is brought into use.

In an automotive underbody part such as a suspension arm, the maximum stress is loaded on an arm portion having a substantially H-shaped section including such a rib and a thin web during use. The site of the arm portion where the maximum stress is loaded varies depending on the whole shape and shape requirements such as the thickness of the automotive underbody part. However, the maximum stress occurs at the site determined by the whole shape and shape requirements of the arm portion, not other joint portions.

However, a forging product having such a lighter-weight shape is increased in variation of working rate with sites in the forging product during hot forging. In hot die forging which is generally performed several times using a mechanical press without reheating, the working rate of hot forging basically tends to greatly vary according to sites.

Therefore, the working rate tends to further increase (severe) in the more thinned web and the more narrowed and thickened rib. Therefore, there is the problem that recrystallized coarse crystal grains (coarsening of crystal grains) more easily occur on a parting line and the vicinity thereof in the more thinned web and the more narrowed and thickened rib at the hot forging temperature.

When crystal grains are easily coarsened in the web and the rib which are located in a maximum stress producing site in the arm portion required to have strength, it is difficult to lighten the weight of the arm portion, consequently the whole of an automotive underbody part, while maintaining high strength. From this viewpoint, in actual situation, the above-mentioned attempt to suppress the occurrence of course crystal grains and refine crystal grains in a conventional 6000 series Al alloy forging material has limitations to improvements with high reproducibility in strength, toughness, and corrosion resistance of an automotive underbody part made of a forging material with a lighter-weight shape.

In consideration of the actual situation, the present invention provides an aluminum alloy forging member having higher strength, higher toughness, higher corrosion resistance even when the shape thereof is weight-lightened.

Means for Solving the Problems

In order to achieve the object, the gist of an aluminum alloy forging material of the present invention is that the material includes an arm portion composed of, by % by mass, 0.5 to 1.25% of Mg, 0.4 to 1.4% of Si, 0.01 to 0.7% of Cu, 0.05 to 0.4% of Fe, 0.001 to 1.0% of Mn, 0.01 to 0.35% of Cr, 0.005 to 0.1% of Ti, Zr controlled to less than 0.15%, and the balance composed of Al and inevitable impurities, the arm portion having a substantially H-shaped width-direction sectional form including a relatively narrow and thick peripheral rib and a relatively wide central web. In a width-direction sectional structure in a maximum stress producing site of the rib, the density of crystals observed in the sectional structure of the maximum stress producing site is 1.5% or less in terms of an average area ratio, and the average spacing between grain boundary precipitates observed in the sectional structure including a parting line, which is produced in forging, is 0.7 μm or more.

In order to achieve the object, in an aluminum alloy forging member of the present invention, in addition to the above-described gist, it is preferred that in a width-direction sectional structure in a maximum stress producing site of the rib, the average diameter of dispersed particles observed in the sectional structure of the maximum stress producing site is 1200 Å or less, the density of the dispersed particles is 4% or more in terms of an area ratio, the area ratio of recrystallized grains observed in the sectional structure of the rib is 10% or less in terms of an average area ratio, and the area ratio of recrystallized grains observed in a sectional structure of the web adjacent to the sectional structure of the rib in the width direction thereof is 20% or less in terms of an average area ratio.

In the forging member, preferably, the density of the crystals is 1.0% or less in terms of an average area ratio, and the average spacing between the grain boundary precipitates is 1.6 μm or more. The aluminum alloy forging material and an aluminum alloy melt, which will be described below, preferably have a composition containing, by % by mass, 0.7 to 1.25% of Mg, 0.8 to 1.3% of Si, 0.1 to 0.6% of Cu, 0.1 to 0.4% of Fe, 0.2 to 0.6% of Mn, 0.1 to 0.3% of Cr, 0.01 to 0.1% of Ti, Zr controlled to less than 0.15%, and the balance composed of Al and inevitable impurities. The composition more preferably contains, by % by mass, 0.9 to 1.1% of Mg, 0.9 to 1.1% of Si, 0.3 to 0.5% of Cu, 0.1 to 0.4% of Fe, 0.2 to 0.6% of Mn, 0.1 to 0.2% of Cr, 0.01 to 0.1% of Ti, Zr controlled to less than 0.15%, and the balance composed of Al and inevitable impurities. Further, the present invention is preferably applied to an aluminum alloy forging material including the web with a thickness of 10 mm or less.

In order to achieve the object, the gist of a method for producing an aluminum alloy forging material of the present invention lies in a method of producing an aluminum alloy forging material having the above-described gist or a preferred gist which will be described below. Namely, the method includes:

casting at an average cooling rate of 100° C./s or more an aluminum alloy melt having a composition containing, by % by mass, 0.5 to 1.25% of Mg, 0.4 to 1.4% of Si, 0.01 to 0.7% of Cu, 0.05 to 0.4% of Fe, 0.001 to 1.0% of Mn, 0.01 to 0.35% of Cr, 0.005 to 0.1% of Ti, Zr controlled to less than 0.15%, and the balance composed of Al and inevitable impurities, or the above-described preferred composition;

homogenizing heat-treating the cast ingot by heating in a temperature range of 460° C. to 570° C. at a heating rate of 10 to 1500° C./hr and maintaining in the temperature range for 2 hours or more;

cooling the ingot to room temperature at a cooling rate of 40° C./hr or more;

reheating the ingot to a hot-forging start temperature;

performing hot die-forging to form an aluminum alloy forging material having a substantially H-shaped width-direction sectional form including a relatively narrow and thick peripheral rib and a thin and relatively wide central web, the forging finish temperature being 350° C. or more;

performing solution treatment by maintaining the material in the temperature range of 530° C. to 570° C. for 20 minutes to 8 hours;

hardening the material at an average cooling rate in the range of 200 to 300° C./s; and performing artificial age hardening.

ADVANTAGES

In the present invention, the width-direction sectional structure of the specified portion in the maximum stress producing site of the rib of the arm portion which includes the aluminum alloy forging material and which has a lighter-weight shape is defined as in the above-described gist. The composition is controlled and the forging material is produced so that the width-direction sectional structure of the specified portion in the maximum stress producing site of the rib of the aluminum alloy forging material after forging is as defined in the above-described gist.

Further, in the present invention, coarsening of crystal grains is suppressed in the rib and web of the arm portion which includes the aluminum alloy forging material and which has a lighter-weight shape, particularly in the specified site where the maximum stress is produced.

Therefore, according to the present invention, it is possible to increase the strength, toughness, and corrosion resistance in the maximum stress producing site of the arm portion which is required to have strength and which will be described below. In particular, even in an aluminum alloy forging material including an arm portion having a substantially H-shaped width-direction sectional form including a relatively wide and thin central web having a wall thickness of 10 mm or less (even in an aluminum alloy forging material having a lighter-weight shape), the strength, toughness, and corrosion resistance are enhanced.

BRIEF DESCRIPTION OF DRAWINGS

FIG. 1 is a plan view showing an automotive underbody part made of an Al alloy forging material.

REFERENCE NUMERALS

1: automotive underbody part, 2: arm portion, 3: rib, 4: web, 5: joint portion, 6: maximum stress producing portion (width direction), 7, 8, 9: sampling portion

BEST MODE FOR CARRYING OUT THE INVENTION

An automotive underbody part and a method of producing an automotive underbody part according to an embodiment of the present invention will be described in detail below.

(Chemical Composition)

Al alloy chemical compositions in an automotive underbody part or an Al alloy forging material constituting an underbody part, an Al forging material used as a raw material for forging, an Al alloy melt used as a raw material for forging according to the present invention are described.

An Al alloy chemical composition in an automotive underbody part of the present invention is required to secure high strength, high toughness, and high corrosion resistance such as resistance to stress corrosion cracking or durability as an underbody part such as an upper arm or a lower arm. Therefore, the chemical composition contains, by % by mass, 0.5 to 1.25% of Mg, 0.4 to 1.4% of Si, 0.01 to 0.7% of Cu, 0.05 to 0.4% of Fe, 0.001 to 1.0% of Mn, 0.01 to 0.35% of Cr, 0.005 to 0.1% of Ti, Zr controlled to less than 0.15%, and the balance composed of Al and inevitable impurities. The term "%" of each element content represents "% by mass".

In order to secure high strength, high toughness, and high corrosion resistance such as resistance to stress corrosion cracking or durability, as a narrower composition range, the chemical composition preferably contains 0.7 to 1.25% of Mg, 0.8 to 1.3% of Si, 0.1 to 0.6% of Cu, 0.1 to 0.4% of Fe, 0.2 to 0.6% of Mn, 0.1 to 0.3% of Cr, 0.01 to 0.1% of Ti, Zr controlled to less than 0.15%, and the balance composed of Al and inevitable impurities. As a more narrower composition range, the composition more preferably contains, by % by mass, 0.9 to 1.1% of Mg, 0.9 to 1.1% of Si, 0.3 to 0.5% of Cu, 0.1 to 0.4% of Fe, 0.2 to 0.6% of Mn, 0.1 to 0.2% of Cr, 0.01 to 0.1% of Ti, Zr controlled to less than 0.15%, and the balance composed of Al and inevitable impurities.

In addition, other elements are allowed to be contained within a range which does not impair the characteristics of the present invention. Further, impurities inevitably mixed from melting material scraps are allowed in a range which does not impair the characteristics of the present invention. Next, the critical meaning and preferred range of the content of each element in the Al alloy forging material of the present invention will be described.

Mg: 0.5 to 1.25%, preferably 0.7 to 1.25%, more preferably 0.9 to 1.1%

Mg precipitates mainly as a needle-like β' phase in crystal grains together with Si by artificial aging and is an essential element for imparting high strength (yield strength) during use of an automotive underbody part. When the Mg content is excessively low, the amount of age hardening in artificial aging is decreased. On the other hand, when the Mg content is excessively high, strength (yield strength) is excessively increased, thereby inhibiting forging properties. In addition, large amounts of $Mg_2Si$ and elemental Si easily precipitate during the course of hardening after solution treatment, thereby decreasing strength, toughness, and corrosion resistance. Therefore, the Mg content is in the range of 0.5 to 1.25%, preferably 0.7 to 1.25%, and more preferably 0.9 to 1.1%.

Si: 0.4 to 1.4%, preferably 0.8 to 1.3%, more preferably 0.9 to 1.1%

Si precipitates mainly as a needle-like β' phase together with Mg by artificial aging and is an essential element for imparting high strength (yield strength) during use of an automotive underbody part. When the Si content is excessively low, sufficient strength cannot be obtained by artificial aging. On the other hand, when the Si content is excessively high, coarse elemental Si particles crystallize and precipitate during casting and in the course of hardening after solution treatment, thereby decreasing corrosion resistance and toughness. In addition, the amount of excessive Si is increased, and thus high corrosion resistance, high toughness, and high fatigue properties cannot be achieved. Further, elongation is decreased to inhibit workability. Therefore, the Si content is in the range of 0.4 to 1.4%, preferably 0.8 to 1.3%, and more preferably 0.9 to 1.1%.

Mn: 0.001 to 1.0%, preferably 0.2 to 0.6%

Cr: 0.01 to 0.35%, preferably 0.1 to 0.3%, more preferably 0.1 to 0.2%

Mn and Cr produce dispersed particles (disperse phase) composed of Al—Mn and Al—Cr intermetallic compounds which are formed by selective bonding of Fe, Mn, Cr, Si, and Al according to the contents thereof during homogenizing heat treatment and subsequent hot-forging. Typical examples of the Al—Mn and Al—Cr intermetallic compounds include an Al—(Fe,Mn,Cr)—Si compound, a $(Fe,Mn,Cr)_3SiAl_{12}$, and the like.

When the dispersed particles of Mn and Cr finely and uniformly disperse at a high density, they have the function to prevent grain boundary migration after recrystallization depending on production conditions and thus have the function to prevent coarsening of crystal grains and refine the crystal grains. In addition, Mn is expected to improve strength and Young's modulus by solution into a matrix.

When the contents of Mn and Cr are excessively low, the above-described effects cannot be expected, and crystal grains are coarsened to decrease strength and toughness. On the other hand, the excessive contents of these elements promote the production of coarse intermetallic compounds and crystals during melting and casting, thereby originating fracture and causing decrease in toughness and fatigue properties. Therefore, both Mn and Cr are preferably contained, and the Mn content is in the range of 0.001 to 1.0%, and preferably 0.2 to 0.6%, and the Cr content is in the range of 0.01 to 0.35%, preferably 0.1 to 0.3%, more preferably 0.1 to 0.2%.

(Zr)

Like Mn and Cr, Zr which produces dispersed particles (disperse phase) causes the inhibition of refining of crystal grains of an ingot depending on casting conditions when Ti is contained. In particular, Zr produces a Ti—Zr compound and causes coarsening of crystal grains by inhibiting refining of Ti or Ti—B crystal grains. Therefore, in the present invention, Zr is not used, and the content of Zr contained as an impurity is minimized. Specifically, the Zr content is less than 0.15% and preferably less than 0.05%.

Cu: 0.01 to 0.7%, preferably 0.1 to 0.6%, more preferably 0.3 to 0.5%

Cu has the effect of contributing to an improvement in strength by solution hardening and the effect of significantly promoting age hardening of a final product in aging treatment. When the Cu content is excessively low, these effects cannot be obtained. On the other hand, when the Cu content is excessively high, the stress corrosion cracking and susceptibility to intergranular corrosion of the structure of the Al alloy forging material are significantly increased, thereby decreasing the corrosion resistance and durability of the Al alloy forging material. Therefore, the Cu content is in the range of 0.01 to 0.7%, preferably 0.1 to 0.6%, and more preferably 0.3 to 0.5%.

Fe: 0.05 to 0.4%, preferably 0.1 to 0.4%

Fe produces dispersed particles (disperse phase) together with Mn and Cr and has the effect of preventing grain boundary migration after recrystallization, preventing coarsening of crystal grains, and refining the crystal grains. When the Fe content is excessively low, these effects cannot be obtained. On the other hand, when the Fe content is excessively high, coarse crystals such as Al—Fe—Si crystals are produced. The crystals degrade fracture toughness and fatigue properties. Therefore, the Fe content is in the range of 0.05 to 0.4% and preferably 0.1 to 0.4%.

Ti: 0.005 to 0.1%, preferably 0.01 to 0.1%

Ti has the effect of refining crystal grains of an ingot to form fine subcrystal grains in a forging material structure. When the Ti content is excessively low, this effect is not exhibited. However, when the Ti content is excessively high, coarse crystals are produced, thereby decreasing the workability. Therefore, the Ti content is in the range of 0.005 to 0.1% and preferably 0.01 to 0.1%.

In addition, the elements described below are impurities, and each of the elements is allowed up to the content described below.

Hydrogen: 0.25 ml/100 g Al or less

Hydrogen ($H_2$) is easily mixed as an impurity, and particularly when the working rate of a forging material is decreased, bubbles due to hydrogen are not pressure-bonded by forging or the like to cause a blister, thereby originating fracture and significantly decreasing toughness and fatigue properties. In particular, an underbody part with increased strength is greatly influenced by hydrogen. Therefore, the hydrogen content per 100 g of Al is preferably as low as possible and 0.25 ml or less.

Also, Zn, V, and Hf are easily mixed as impurities and inhibit the characteristics of an underbody part. Therefore, a total of contents of these elements is less than 0.3%.

Further, B is an impurity and has the same effect as Ti, i.e., the effect of refining crystal grains of an ingot and improving workability of extrusion and forging. However, when the content exceeds 300 ppm, coarse crystals and precipitates are produced, thereby decreasing the workability. Therefore, B is allowed up to a content of 300 ppm or less.

(Specified Portion of Automotive Underbody Part where Maximum Stress is Produced)

In the present invention, in the arm portion of the automotive underbody part including a forging material with a lighter-weight shape, the structure of the rib in a specified portion where maximum stress occurs is defined as in the above-described gist. Therefore, description is first made of the meaning of the specified portion of the automotive underbody part where maximum stress is produced according to the present invention.

First, a typical shape of a lighter-weight shape of the automotive underbody part of the present invention is described with reference to FIGS. 1(*a*) and (*b*). FIG. 1(*a*) is a plan view showing the whole shape of an automotive underbody part 1 and a specified site of an arm portion where the maximum stress is produced, and FIG. 1(*b*) is a sectional view (sectional view of the specified site of the arm portion where the maximum stress is produced) taken along line A-A in FIG. 1(*a*).

In FIG. 1(*a*), the automotive underbody part 1 is made of an aluminum alloy forging material forged into a near net shape of the part 1. As a shape common to automotive underbody parts, the automotive underbody part 1 has a substantially triangular whole shape as shown in FIG. 1(*a*), and joint portions 5*a*, 5*b*, and 5*c* such as ball joints are disposed at the apexes of a triangle, the joint portions being connected by arm portions 2*a* and 2*b*. Each of the arm portions 2*a* and 2*b* necessarily has ribs which are provided in the periphery (both sides) in the width direction to extend along the longitudinal direction of the arm portion. The arm portion 2*a* has ribs 3*a* and 3*b*, and the arm portion 2*b* has ribs 3*a* and 3*c*. In addition, each of the arm portions 2*a* and 2*b* necessarily has a web provided at the center in the width direction thereof so as to extend along the longitudinal direction of the arm portion. The arm portion 2*a* has a web 4*a*, and the arm portion 2*b* has a web 4*b*.

Each of the ribs 3*a*, 3*b*, and 3*c* is relatively narrow and thick in common to automotive underbody parts. On the other hand, each of the webs 4*a* and 4*b* has a thickness of 10 mm or less and is thinner than the ribs 3*a*, 3*b*, and 3*c* and is relatively wide in common to automotive underbody parts. Therefore, each of the arm portions 2*a* and 2*b* has a substantially H-shaped section taken along the width direction thereof in common to automotive underbody parts. In the H-shaped section, both vertical wall portions correspond to the ribs 3*a* and 3*b* or 3*c*, and the central lateral wall portion corresponds to the web 4*a* or 4*b*.

On the assumption of the whole structure and shape, in the automotive underbody part, the structures of the arm portions 2*a* and 2*b* and the ball joint portions 5*a*, 5*b*, and 5*c* are designed so that a specified portion where the maximum stress is produced (maximum stress is loaded) during use is loaded on the ball joint side of each rib. Of course, the maximum stress producing site varies depending on the structural design conditions, but is necessarily located on the ball joint side of any one of the ribs.

In the automotive underbody part shown in FIG. 1, the specified site where the maximum stress is produced during use (maximum stress is loaded) corresponds to a shadowed portion extending in the longitudinal direction of any one of the ribs on the ball joint side as shown by oblique lines in FIG. 1(*a*). Namely, in an example shown in FIG. 1(*a*), the specified site corresponds to the shadowed portion partially including the rib 3*a* and the web 4*a* on one of the sides of the arm portion 2*a* near the ball joint portion 5*a*. Further, the maximum stress producing site is not uniform in a section of the arm portion in the width direction, and is located in a portion 6*a* at the upper end of the rib 3*a*, which is encircled in FIG. 1(*b*). When the specified site where the maximum stress is produced during use is located not only in the rib 3*a* but also in the rib 3*b*, the maximum stress producing site is also located in a portion 6*b* at the upper end of the rib 3*b*, which is encircled in FIG. 1(*b*).

In the automotive underbody part, of course, large stress is also produced (loaded) in the joint portions 5*a*, 5*b*, and 5*c* used for another member, but this is not maximum stress. In the automotive underbody part, the maximum stress is necessarily produced at a ball joint-side site of the specified rib depending on the whole shape and shape requirements of the arm portion, as shown in FIG. 1(*a*).

When crystal grains are easily coarsened particularly in the rib at the maximum stress producing site of the arm portion, which is required to have strength, or in the web including the rib, it is difficult to lighten the weight of the arm portion, consequently the weight of the whole automotive underbody part, while maintaining high strength.

Therefore, in the present invention, the structure of the specified site (one of the sides of the arm portion 2*a* on the ball joint portion 5*a* side: including parts of both the rib 3*a* and web 4*a*) shown by oblique lines in FIG. 1(*a*) in the arm portion, where the maximum stress is loaded, is defined as in the above-described gist. If production is possible, not only the structure of the specified site of the arm portion where the maximum stress is loaded but also the whole structure of the arm portions 2*a* and 2*b* are preferably defined as in the above-described gist.

(Structure)

In the present invention, in the automotive underbody part, the structure, crystals, and grain boundary precipitates of the rib 3*a* which is the maximum stress producing site of the arm portion described with reference to FIG. 1 are defined. Preferably, the dispersed particles composed of the intermetallic compound and the ratio of recrystallized grains are also defined. In addition, preferably, the ratio of recrystallized grains in the structure of the web 4*a* at the maximum stress producing site of the arm portion is defined. However, the crystals in the structure of the rib 3*a* are defined in the structure of the maximum stress producing site in the section in the width direction. Further, the grain boundary precipitates and the dispersed particles in the structure of the rib 3*a* are defined in the structure on the parting line in the section in the width direction. Further, the ratios of recrystallized crystals in the structures of the rib 3*a* and the web 4*a* are defined in the section of the maximum stress producing site in the width direction thereof.

(Crystals)

In the present invention, the crystals in the width-direction sectional structure of the arm portion 2*a* where the maximum stress is loaded are defined in the upper end 6*a* of the rib 3*a* which is encircled in FIG. 1(*b*) and which is the maximum stress-loaded site in the section in the width direction. As described above, when the specified site where the maximum stress is produced during use is located not only in the rib 3*a* but also in the rib 3*b*, the portion 6*b* at the upper end of the rib 3*b*, which is encircled in FIG. 1(*b*), is also a site where the crystals are defined. In the present invention, in the arm portion (particularly, the rib) where the maximum stress is loaded, the occurrence of coarse crystals at the specified site is suppressed to suppress the occurrence of crystals originating fracture, thereby improving the toughness of the automotive underbody part.

In the present invention, the crystals are Al—Fe—Si crystals. As described above, when the Fe content is excessively high, coarse crystals such as the Al—Fe—Si crystals, which impair fracture toughness and fatigue properties, are produced. However, Fe is an element which is particularly easily mixed as an impurity from a melting raw material such as scraps. Therefore, even at a Fe content corresponding to a usual impurity level, there is the high possibility that course crystals such as the Al—Fe—Si crystals are produced.

Therefore, in the present invention, the density of the Al—Fe—Si crystals is defined in order to suppress course crystals such as the Al—Fe—Si crystals in the structure. Namely, the average area ratio of the Al—Fe—Si crystals in the structure is 1.5% and preferably 1.0%. When the average area ratio of the Al—Fe—Si crystals in the structure exceeds 1.5% or less and preferably 1.0% or less, coarse crystals are produced, and thus the fracture toughness and fatigue properties of the automotive underbody part are degraded.

(Measurement of Average Area Ratio of Crystals)

The average area ratio of the Al—Fe—Si crystals is measured by observing a width-direction sectional structure of a portion 7 including the portion 6*a* at the upper end of the rib 3*a*, which is encircled in FIG. 1(*b*) and which is the site where the maximum stress is loaded in the section in the width direction. More specifically, the portion is observed at a plurality of positions and photographed using SEM (scanning electron microscope) with a magnification of ×500 so that the total observation area is 0.2 $mm^2$, followed by digital processing of the resultant images and calculation. In order to impart reproducibility to the measurement, desired 10 measurement positions are observed, and the measured values are averaged to determine the average area ratio.

(Grain Boundary Precipitates)

In the present invention, in the width-direction sectional structure of the arm portion 2*a* where the maximum stress is loaded, the grain boundary precipitates are defined in a portion 8 on (including) the parting line PL of the rib 3*a* shown in FIG. 1(*b*). As described above, when the specified site where the maximum stress is produced during use is located not only in the rib 3*a* but also in the rib 3*b*, a portion on (including) the parting line PL corresponding to the portion 8 of the rib 3*a* is also a site where the grain boundary precipitates are defined.

The parting line PL shown in FIG. 1(*b*) corresponds to a parting plane which is inevitably produced as a boundary plane (parting plane) on the boundary of both the upper and lower dies used in hot die forging. If fracture occurs at the upper end 6*b* of the rib 3*b* shown in FIG. 1(*b*), which is the maximum stress-loaded site, due to precipitates as origins, the fracture propagates at the grain boundaries toward the parting line PL. The grain boundary propagation of fracture toward the parting line PL greatly depends on the presence of grain boundary precipitates. In other words, in the present invention, when the precipitates on the grain boundaries in the arm portion (particularly the rib) where the maximum stress is loaded are decreased, the grain boundary propagation of fracture is inhibited or suppressed, thereby improving the fracture toughness and fatigue properties of the automotive underbody part.

In the present invention, the grain boundary precipitates are composed of $Mg_2Si$ and elemental Si. In the present invention, $Mg_2Si$ is mainly precipitated as a β' phase in crystal grains to impart high strength (yield strength) to the automotive underbody part. However, when $Mg_2Si$ and elemental Si precipitate at the grain boundaries, fracture is originated to promote the grain boundary propagation of fracture toward the parting line PL, thereby degrading the fracture toughness and fatigue properties of the automotive underbody part.

Even when each of the contents of $Mg_2Si$ and elemental Si is within the proper specified range, at an excessively low heating rate or cooling rate, $Mg_2Si$ and elemental Si easily precipitate coarsely or densely at grain boundaries in heat history of casting, homogenizing heat treatment, hot forging, solution treatment, and hardening in a usual production process.

In the present invention, therefore, in the width-direction sectional structure of the arm portion 2*a* where the maximum stress is loaded, the grain boundary precipitates are defined in the portion 8 on (including) the parting line PL of the rib 3*a* shown in FIG. 1(*b*). Namely, the average spacing of grain boundary precipitates of $Mg_2Si$ and elemental Si at the grain boundaries of the structure is 0.7 μm or more and preferably 1.6 μm or more in order to decrease the precipitates in the grain boundaries. When the average spacing of grain boundary precipitates of $Mg_2Si$ and elemental Si of the structure is less than 0.7 μm and preferably less than 1.6 μm, the grain boundary precipitates are coarsely or densely precipitate on the grain boundaries, thereby degrading the fracture toughness and the fatigue properties of the automotive underbody part.

(Measurement of Grain Boundary Precipitates)

The average spacing of the grain boundary precipitates is measured by observing, in ten fields of view, the structure (in the sectional structure in the width direction) of the portion 8 on (including) the parting line PL of the rib 3*a* shown in FIG. 1(*b*) using TEM (transmission electron microscope) with a magnification of ×20,000, and a value l/n is calculated from the number of grain boundary precipitates per grain boundary length l. In order to impart reproducibility to the measurement, desired 10 measurement positions are observed, and the measured values are averaged to determine the average area ratio.

(Dispersed Particles)

In the present invention, preferably, in the width-direction sectional structure of the arm portion 2*a* where the maximum stress is loaded, like the grain boundary precipitates, the dispersed particles are also defined in the portion 8 on (including) the parting line PL of the rib 3*a* shown in FIG. 1(*b*). As described above, when the specified site where the maximum stress is produced during use is located not only in the rib 3*a* but also in the rib 3*b*, a portion on (including) the parting line PL of the rib 3*b* corresponding to the portion 8 of the rib 3*a* is also a site where the grain boundary precipitates are defined.

The parting line PL is a portion where the working rate of forging is maximized and recrystallization easily occurs. Therefore, it is important to inhibit recrystallization in the portion where recrystallization most occurs. Therefore, in the present invention, the dispersed particles which suppress recrystallization in the portion where recrystallization most occurs are defined to suppress recrystallization and coarsening of crystal grains due to recrystallization. As a result, in the arm portion (particularly in the rib) where the maximum stress is loaded, recrystallization and grain boundary fracture due to coarsening of crystal grains are suppressed, thereby improving strength and toughness of the automotive underbody part.

In the present invention, the dispersed particles are composed of Al—Mn, Al—Cr, or Al—Zr intermetallic compounds. As described above, when the dispersed particles are finely uniformly dispersed at a high density, there is the effect of preventing grain boundary migration after recrystallization, thereby increasing the effect of preventing recrystallization and coarsening of crystal grains and refining the crystal grains. However, at an excessively low heating rate or cooling rate, coarsening easily occurs in heat history of casting, homogenizing heat treatment, hot forging, solution treatment, and hardening in a usual production process, depending on the production conditions. Therefore, the effect of suppressing recrystallization (refining the crystal grains) is lost, thereby possibly degrading the fracture toughness and the fatigue properties of the automotive underbody part.

Therefore, in the present invention, preferably, the dispersed particles in the structure are finely uniformly dispersed, and the average diameter as the size of the dispersed particles and the average area ratio as the density are defined. Namely, unlike the crystals and grain boundary precipitates in the structure of the rib 3*a*, it is not essential to define the dispersed particles, but it is preferred that the average diameter of the dispersed particles is 1200 Å or less, and the density of the dispersed particles is 4% or more in terms of the average area ratio.

When the average diameter of the dispersed particles exceeds 1200 Å or the density of the dispersed particles is lower than 4% or more in terms of the average area ratio, the particles cannot be finely uniformly dispersed. Therefore, the fracture toughness and the fatigue properties of the automotive underbody part are possibly degraded.

(Measurement of Dispersed Particles)

The average diameter and average area ratio of the dispersed particles are measured by observing, in ten fields of view, the structure (in the sectional structure in the width direction) of the portion 8 on (including) the parting line PL of the rib 3*a* shown in FIG. 1(*b*) using TEM (transmission electron microscope) with a magnification of ×20,000. In image analysis, the maximum length of each disperse particle is measured as a diameter, and an average of the maximum lengths of the observed dispersed particles is calculated as the average diameter. Similarly, in image analysis, the total area of the observed dispersed particles is determined, and the ratio of the total area to the area of the observation fields of view is calculated as the average area ratio of the dispersed particles. In order to impart reproducibility to the measurement, desired 10 measurement positions are observed, and the measured values are averaged to determine the average area ratio.

(Recrystallization Area Ratio)

In the present invention, preferably, the area ratio of recrystallized grains (referred to as the "recrystallization area ratio) is defined in two portions in the width-direction sectional structure of the arm portion 2*a* where the maximum stress is loaded, i.e., the whole structure of the width-direction section of the rib 3*a* shown in FIG. 1(*b*), including the parting line PL where recrystallization most occurs, and the whole structure of the width-direction section of the web 4*a* adjacent to the rib 3*a*. Therefore, it is preferred to define the recrystallization area ratio of the arm portion including the rib and the web.

Like in the rib 3*a*, the web 4*a* includes the parting line PL and easily causes recrystallization. In addition, the size (recrystallization area ratio) of crystal grains in the web also greatly influences fatigue strength. The web has a different forging working rate from that of the rib, and thus the recrystallization area ratio of the rib is likely to be different from that of the rib. Therefore, when the recrystallization area ratio of the arm portion where the maximum stress is loaded is defined, it is necessary to define the ratios of both the web and the rib.

Therefore, it is preferred that recrystallization is suppressed in the arm portion (particularly the rib and the web) where the maximum stress is loaded to increase sub-crystal grains and refine the crystal grains to about 10 μm or less, thereby suppressing grain boundary fracture in the arm portion and improving strength and toughness of the automotive underbody part.

In the whole structure of the width-direction section of the rib 3*a* shown in FIG. 1(*b*), the rib is defined (measured) at two positions, i.e., the portion 7 including the upper end 6*a* of the rib 3*a*, which is encircled in FIG. 1(*b*) and which is a site where the maximum stress is loaded in the width-direction section, and the portion 8 including the parting line PL where recrystallization most occurs. Namely, as a typical ratio of the whole structure of the width-direction section of the rib, the area ratios of recrystallized grains in the two measurement portions 7 and 8 are defined to 10% or less in terms of the average area ratio in order to increase sub-crystal grains and refine the average crystal grains to about 10 μm or less. Therefore, the grain boundary fracture of the rib is suppressed to improve strength and toughness of the automotive underbody part.

In the whole structure of the width-direction section of the web 4*a* shown in FIG. 1(*b*), the web is defined (measured) in a portion 9 including the parting line PL where recrystallization most occurs. Namely, as a typical ratio of the whole structure of the width-direction section of the web, the area ratio of recrystallized grains in the measurement portion 9 is defined to 20% or less in terms of the average area ratio in order to increase sub-crystal grains and refine the average crystal grains to about 10 μm or less. Therefore, the grain boundary fracture of the web is suppressed to improve strength and toughness of the automotive underbody part.

(Measurement of Recrystallization Area Ratio)

The area ratio of recrystallization is measured by observing, using an optical microscope with a magnification of about ×400, a mirror-finished surface prepared by mechanically polishing an observation portion (sectional structure) sample of each of the rib and the web to 0.05 to 0.1 mm and then electrolytically etching the sample. In image processing, the ratio of the recrystallization area to the area of field of view is calculated. The recrystallized grains have a large size and thus easily reflect light and have a pale color, while crystal grains including sub-crystal grains have a small size and thus have a dark color. Therefore, the recrystallized grains and crystal grains can be distinguished by a difference in size and a difference in color density, thereby permitting image processing. In order to impart reproducibility to the measurement, desired 10 measurement positions are observed, and the measured values are averaged to determine the average area ratio.

As described above, the structure is defined so that the strength and toughness are increased particularly in the rib and the web of the arm portion which is the maximum stress producing site (i.e., the maximum stress producing site of the arm portion). Therefore, even in the automotive underbody part having the substantially H-shaped section arm portion including the thin and relatively wide central web having a thickness of 10 mm or less (even in the forging material automotive underbody part with a lighter-weight shape), the strength, toughness, and corrosion resistance are enhanced.

(Production Method)

Next, the method of producing the Al alloy forging material of the present invention is described. The process for producing the Al alloy forging material of the present invention can be performed by a usual method. However, in order to increase the strength, toughness, and corrosion resistance of a forging material automotive underbody part with a lighter-weight shape, particularly, an automotive underbody part having the above-described structure, it is necessary to perform each of the production steps described below under specified conditions.

(Casting)

When an Al alloy melt prepared by melting within the above-described specified Al alloy composition range is cast, a usual melt casting method such as continuous casting and rolling, semicontinuous casting (DC casting), or hot-top casting is appropriately selected.

However, when an aluminum alloy melt within the specified Al alloy composition range is cast, the average cooling rate is 100° C./s or more in order to refine the Al—Fe—Si crystals and decrease the dendrite secondary arm spacing (DAS) to 20 μm or less in at least the structure of the maximum stress producing site of the arm portion of the automotive underbody part (hereinafter, the structure of the rib 3*a* at the maximum stress producing site or the structures of both the rib 3*a* and the web 4*a*).

When the average cooling rate in casting is excessively decreased to less than 100° C./s, the Al—Fe—Si crystals are coarsened in the structure of at least the maximum stress producing site of the arm portion of the automotive underbody part, and the average area ratio cannot be controlled to 0.1% or less. In addition, the dendrite secondary arm spacing (DAS) cannot be decreased to 20 μm or less, and DAS is increased. As a result, in the forging material automotive underbody part with a lighter-weight shape, the strength, toughness, and corrosion resistance cannot be enhanced.

(Homogenizing Heat Treatment)

In homogenizing heat treatment of the cast ingot, the ingot is heated within the temperature range of 460° C. to 570° C., preferably 460° C. to 520° C., at a heating rate of 10 to 1500° C./hr, preferably 20 to 1000° C./hr, and then maintained in this temperature range for 2 hours or more. Further, the cooling rate after homogenizing heat treatment is 40° C./hr or more, and the ingot is cooled to room temperature at this cooling rate.

When the heating rate in homogenizing heat treatment is excessively high or excessively low, the dispersed particles are coarsened and cannot be finely and uniformly dispersed, thereby degrading the effect of refining crystal grains by fine uniform dispersion.

When the homogenizing heat treatment temperature is excessively high, crystals are easily dissolved, but the dispersed particles are coarsened and cannot be finely uniformly dispersed, thereby degrading the effect of refining crystal grains by fine uniform dispersion. On the other hand, when the homogenizing heat treatment temperature is excessively low, crystals are not sufficiently dissolved, leaving coarse crystals. Therefore, it is difficult to enhance the strength and toughness of the automotive underbody part.

When the retention time in the homogenizing heat treatment temperature range is less than 2 hours, the homogenization time is sufficient, and crystals are not sufficiently dissolved, leaving coarse crystals. Therefore, it is difficult to enhance the strength and toughness of the automotive underbody part.

When the cooling rate after the homogenizing heat treatment is less than 40° C./hr, $Mg_2Si$ precipitates in crystal grains before solution treatment. Therefore, $Mg_2Si$ to be precipitated by solution treatment is insufficient, resulting in insufficient solution treatment. Therefore, it is difficult to enhance the strength and toughness of the automotive underbody part.

(Hot Forging)

After the homogenizing heat treatment, the ingot cooled to room temperature at the cooling rate is reheated to the hot forging start temperature. Then, the ingot is hot-forged into a final product shape (near net shape) of the automotive underbody part by forging with a mechanical press or hydraulic press. This shape is the above-described lighter-weight shape, and the automotive underbody part includes the arm portion with a substantially H-shaped sectional form including a relatively narrow and thick peripheral rib and a thin and relatively wide central web having a thickness of 10 mm or less.

The finish temperature of the hot forging is 350° C. or more, and the forging start temperature is a temperature which allows the finish temperature to be set to 350° C. or more depending on the number of times of hot forging which is performed several times without reheating. The automotive underbody part is subjected to several times of hot-forging, such as rough forging, intermediate forging, and finish forging, without reheating. Therefore, when the hot forging start temperature is less than 350° C., it is difficult to secure a high finish temperature of 350° C. or more.

When the hot forging finish temperature is less than 350° C., the dispersed particles cannot be finely uniformly dispersed, and thus the average crystal grain size of the Al alloy cannot be decreased to 50 μm or less in the maximum stress producing site of the arm portion of the automotive underbody part even when the forging material automotive underbody part has a lighter-weight shape. In addition, the ratio of sub-crystal grains is decreased. As a result, the strength, toughness, and corrosion resistance of the automotive underbody part cannot be enhanced.

In order to secure the effect of the dispersed particles, preferably, the heating rate of heating for hot forging is as high as 100° C./hr or more, and the cooling rate after the hot forging is as high as 100° C./hr or more.

(Tempering)

After the hot forging, tempering T6, T7, T8, or the like is performed for achieving necessary strength, toughness, and corrosion resistance of the automotive underbody part. Tempering T6 includes artificial age hardening for achieving the maximum strength after solution treatment and hardening. Tempering T7 includes overage hardening beyond artificial age hardening conditions for achieving the maximum strength after solution treatment and hardening. Tempering T8 includes artificial age hardening for achieving the maximum strength by cold working after solution treatment and hardening.

In the tempering, the structure in at least the maximum stress producing site of the arm portion is finally optimized as defined in the present invention. Namely, the density of the Al—Fe—Si crystals is 1.0% or less in terms of the average area ratio, the average maximum diameter of the $Mg_2Si$ grain boundary precipitates is 2 μm or less, the average spacing of the $Mg_2Si$ grain boundary precipitates is 1.6 μm or more, the average diameter of the dispersed particles composed of the Al—Mn or Al—Cr intermetallic compound is 1200 Å or less, and the density thereof is 5% or less in terms of the average area ratio.

With respect to a difference of artificial age hardening after solution treatment and hardening, a T7 tempered material has a high ratio of β phase precipitates on grain boundaries because of overage hardening. The β phase is slightly dissolved under a corrosive environment, thereby decreasing the susceptibility to intergranular corrosion and increasing the resistance to stress corrosion cracking. On the other hand, among these tempered materials, a T6 tempered material has a high ratio of β' phase because of artificial age hardening for achieving the maximum strength. The β' phase is easily dissolved under a corrosive environment, thereby increasing the susceptibility to intergranular corrosion and decreasing the resistance to stress corrosion cracking. Therefore, when the Al alloy forging material is the T7 tempered material, yield strength is slightly decreased, but the corrosion resistance is more increased as compared with the other tempered materials.

The solution treatment includes retention in the temperature range of 530° C. to 570° C. for 20 minutes to 8 hours. When the solution treatment temperature is excessively low or the time is excessively short, the solution treatment is insufficient, and solid solution of $Mg_2Si$ is insufficient, thereby decreasing strength. In heating to the solution treatment temperature, it is preferred that the heating rate is 100° C./hr or more in order to prevent coarsening of the dispersed particles and secure the effect of the dispersed particles.

After the solution treatment, hardening is performed at an average cooling rate of 200 to 300° C./s. In order to secure the average cooling rate, cooling in hardening is preferably performed by water cooling. When the cooling rate in hardening is decreased, $Mg_2Si$ and Si precipitate on grain boundaries, and thus grain boundary fracture easily occurs in a product after artificial aging, thereby decreasing toughness and fatigue properties. In addition, $Mg_2Si$ and Si stable phases are formed in crystal grains during the course of cooling, and the amounts of β phase and β' phase precipitating in artificial aging are decreased, thereby decreasing strength.

On the other hand, when the cooling rate is increased, the amount of hardening distortion is increased, and thus a correction step is required after hardening, thereby causing the problem of increasing the number of correction steps. In addition, residual stress is increased to cause the new problem of decreasing the dimensional and shape accuracy of a product. From this viewpoint, in order to shorten the production process and decrease the cost, hot-water hardening at 50° C. to 85° C. is preferred because hardening distortion is reduced. When the hot-water hardening temperature is lower than 50° C., hardening distortion is increased, while when the hot-water hardening temperature exceeds 85° C., the cooling rate is excessively decreased to decrease toughness, fatigue properties, and strength.

Conditions for the artificial aging after solution treatment and hardening are selected from the conditions of the T6, T7, and T8 tempering within the temperature range of 530° C. to 570° C. and the retention time range of 20 minutes to 8 hours.

In addition, an air furnace, an induction heating furnace, a niter furnace, or the like is properly used for the homogenizing heat treatment and solution treatment. Further, an air furnace, an induction heating furnace, an oil bath, or the like is properly used for the artificial age hardening.

The automotive underbody part of the present invention may be subjected to machining and surface treatment necessary for an automotive underbody part before and after the tempering.

Although the present invention is described in further detail below with reference to examples, the present invention is not limited to these examples, and appropriate modification can be made within a range which complies with the gist described above and below. The modification is included in the technical scope of the present invention.

EXAMPLES

Next, examples of the present invention are described. The structure, mechanical properties, and corrosion resistance of each of the automotive underbody parts (forging materials) produced under various conditions were measured and evaluated.

An Al alloy ingot (Al alloy forging material: cast rod having a diameter of 82 mm) with each of the chemical compositions of alloy Nos. A to R and S to Y shown in Table 1 was cast by semicontinuous casting at a relatively high cooling rate shown in Table 2. Among alloy Nos. shown in Table 1, alloy Nos. A to C, D, F, H, L, M, N, and Q are examples of the present invention, and alloy Nos. E, G, I, J, K, O, P, R, and S to Y are comparative examples. With respect to the other impurity contents of the Al alloy examples shown in Table 1, the total content of Zn, V, and Hf of each Al alloy example was less than 0.2%, and the B content was 300 ppm or less, excepting Comparative Example P having an excessively high content of a specified impurity such as Zr. The hydrogen contents of all Al alloy examples were 0.10 to 0.15 ml per 100 g of Al.

The outer surface of each of the Al alloy ingots with the chemical compositions was polished to a thickness of 3 mm and cut into a length of 500 mm. Then, homogenizing heat treatment, hot die-forging using a mechanical press, solution hardening treatment, and age hardening were performed under the conditions shown in Tables 2 and 3 to produce an automotive underbody part of the shape shown in FIG. 1. In the homogenizing heat treatment, each of the heating rate, the cooling rate, and the retention time at the homogenizing temperature was changed. In the hot forging, the finish temperature was changed. In the solution hardening treatment, each of the solution treatment temperature, the retention time at the solution treatment temperature, and the cooling rate was changed. In the age hardening, each of the ageing temperature and the retention time at the ageing temperature was changed.

The thus-produced automotive underbody part had arm portions 2*a* and 2*b* with a substantially H-shaped section including relatively narrow peripheral ribs 3*a*, 3*b*, and 3*c* having a thickness of 30 mm and a relatively wide (width: 60 mm) central webs 4*a* and 4*b* having a thickness of 10 mm.

The cooling rate of the homogenizing heat treatment was controlled by whether or not a cooling fan was used after discharge from the furnace. When the cooling rate was 100° C./hr, forced air cooling was performed using the fan, while when the cooling rate was 20° C./hr, standing to cool was performed by a usual method without using the fan.

In the forging with the mechanical press, forging was performed tree times using upper and lower dies with a flash land space of 1.5 to 3 mm without reheating. The total working rate of the automotive underbody part (forging material) in terms of an amount of distortion (%) was 5 to 80% in the ribs 3*a*, 3*b*, and 3*c* and 60 to 90% in the webs 4*a* and 4*b* of the automotive underbody part.

The amount of distortion (%) of the hot forging was calculated by the expression $C=[(B-A)/B]\times 100\%$ wherein A is the average crystal grain spacing in the maximum stress producing site (the shadowed portion in FIG. 1) of the arm portion, and B is the average cell layer size of the ingot. The average cell layer size B of the ingot was determined by dividing the region from the upper surface to the center of a plane vertical to the casting direction into four equal parts and averaging the values measured at a total of five positions in the region from the outer surface to the center of the ingot before surface polishing. In this case, when a clear flow line was not formed due to a small amount of distortion, the amount was calculated by $C=[(B-E)/B]\times 100\%$ using the size (minimum length direction) E of the ingot cell layer remaining in the forged material.

The solution treatment was performed using an air furnace, and water hardening was performed after the solution treatment. The temperature of the water was adjusted to control the cooling rate of water hardening as shown in Tables 2 and 3. When the cooling rate was 200° C./s, hardening was performed with hot water of 60° C., when the cooling rate was 250° C./s, hardening was performed with hot water of 40° C., and when the cooling rate was 300° C./s, hardening was performed with water of room temperature of about 20° C. When the cooling rate was 20° C./s, air cooling was performed.

Tables 4 and 5 show the states of crystals in the portion 7 and the grain boundary precipitates and dispersed particles in the portion 8, and the recrystallization area ratios of the portions 7 and 8 in a section of the rib 3*a* in the width direction shown in FIG. 1(*b*) at the maximum stress producing site (the shadowed portion in FIG. 1) of the arm portion of each of the produced automotive underbody parts. Also, Table 4 and 5 show the recrystallization area ratio of the portion 9 of the web 4*a* adjacent to the rib 3*a* shown in FIG. 1(*b*).

Further, Tables 4 and 5 show the characteristics of a tensile specimen including the portion 7 in the section of the rib 3*a* in the width direction of each of the automotive underbody parts. Further, Tables 4 and 5 show the characteristics of a tensile specimen including the portion 9 in the section of the web 4*a* in the width direction thereof. In Tables 2 to 5, Al alloy Nos. correspond to Al alloy Nos. in Table 1. Table 4 is continued from Table 2, and the numbers in Table 2 correspond to the respective numbers in Table 5. Table 5 is continued from Table 3, and the numbers in Table 3 correspond to the respective numbers in Table 5.

(Mechanical Properties)

Each of a tensile specimen A (L direction) and a Charpy specimen B (LT direction) was collected at two desired positions including each of the rib 3*a* and the web 4*a* in the longitudinal direction, and tensile strength (MPa), 0.2% yield strength (MPa), elongation (%), and Charpy impact value were measured. An average was determined for each property.

(Susceptibility to Intergranular Corrosion)

A test of susceptibility to intergranular corrosion was performed for a specimen which was collected from at least the maximum stress producing site (the shadowed portion in FIG. 1) of the arm portion of each of the automotive underbody part so as to include both the portions 7 and 8 of the rib 3*a*. The test of susceptibility to intergranular corrosion was performed according to the provisions of old JIS-W1103. After immersion for a specified time of 6 hours under the conditions, the specimen was pulled up, and a section of the specimen was cut, polished, and measured with respect to a corrosion depth from the surface using an optical microscope. The magnification was ×100. When the corrosion depth was up to 200 μm or less, corrosion was considered as slight corrosion and evaluated as "O". When the corrosion depth exceeded 200 μm, corrosion was considered as large corrosion and evaluated as "x".

(Stress Corrosion Cracking)

A test of stress corrosion cracking was performed for a C-ring specimen which was collected from at least the maximum stress producing site (the shadowed portion in FIG. 1) of the arm portion of each of the automotive underbody part so as to include both the portions 7 and 8 of the rib 3*a*. The test of stress corrosion cracking was performed for the C-ring specimen under conditions according to the provisions of an alternate immersion method of ASTM G47. However, on the basis of a simulation in which the automotive underbody part is used with tensile stress applied thereto, the test was performed under conditions severer than actual operation conditions, in which a stress of 75% of the L-direction yield strength of the specimen for the mechanical properties was loaded in the ST direction of the C-ring specimen.

Under these conditions, immersion in salt water and pulling up of the C-ring specimen were repeated to measure a time required until stress corrosion cracking occurred in the specimen. The results are shown in Tables 4 and 5. When the time required to the occurrence of stress corrosion cracking is 200 hours or more, the corrosion of the automotive underbody part is evaluated as good, while when the time is less than 200 hours, the corrosion is evaluated as poor. The results are also shown in Tables 4 and 5.

Tables 4 and 5 indicate that the composition and production conditions of each of the examples of the invention are within preferred ranges. As a result, the structure of the maximum stress producing site of the arm portion of the automotive underbody part of each of the examples of the present invention satisfies the definitions of the present invention. Namely, the density of crystals observed in the sectional structure in the width direction at the maximum stress producing site of the rib is 1.5% or less in terms of the average area ratio, and the average spacing of grain boundary precipitates is 0.7 μm or more. As a result, the tensile strengths of both the rib and the web of each example of the invention are 350 MPa or more, and the Charpy impact value of the rib is 10 J/cm$^2$ or more. In addition, each of the examples of the invention is excellent in susceptibility to intergranular corrosion and stress corrosion cracking resistance of the rib at the maximum stress producing site.

Among the examples of the present invention, the compositions (each element content) of Examples 1 to 3 of the invention are within preferred ranges. Also, in the structure of each of Examples 1 to 3, the dispersed particle size is 1200 Å or less in terms of average diameter, and the density of the dispersed particles is in a preferred range of 4% or more in terms of the average area ratio. Further, the area ratio of recrystallized grains observed in a sectional structure of the rib is 10% or less in terms of the average area ratio. Further, the area ratio of recrystallized grains observed in a sectional structure in the width direction of the web adjacent to the sectional structure of the rib is 20% or less in terms of the average area ratio.

As a result, in Examples 1 to 3 of the invention, the tensile strengths of both the rib and the web are 400 MPa or more, and the Charpy impact value of the rib is 15 J/cm$^2$ or more. In addition, each of Examples 1 to 3 of the invention is excellent in susceptibility to intergranular corrosion and stress corrosion cracking resistance of the rib at the maximum stress producing site.

On the other hand, in spite of using an Al alloy with the composition B within the range of the present invention, Comparative Examples 4, 5, and 9 to 16 produced under conditions out of the optimum production conditions do not satisfy the definitions of the structure at the maximum stress producing site of the arm portion of the automotive underbody part. As a result, the comparative examples are significantly inferior to the examples of the invention in any one of the strength, toughness, and corrosion resistance of the maximum stress producing site of the arm portion of the automotive underbody part.

In Comparative Example 4, the casting cooling rate is excessively low, while in Comparative Example 5, the soaking temperature is excessively low. In Comparative Example 9, the soaking cooling rate is excessively low, while in Comparative Example 10, the forging finish temperature is excessively low. In Comparative Example 11, the solution treatment temperature is excessively low, while in Comparative Example 12, the solution treatment temperature is excessively high. In Comparative Example 13, the cooling rate in hardening is excessively low, while in Comparative Example 14, the soaking temperature is excessively high, and thus burning (local melting) occurs in the ingot, thereby making the subsequent process and characteristic evaluation impossible. In Comparative Example 15, the soaking heating rate is excessively low, while in Comparative Example 16, the soaking heating rate is excessively high.

In addition, Comparative Examples 18, 20, 22 to 24, 28, 29, and 31 to 38 using Al alloys E, G, I, J, K, O, P, R, and S to Y with the compositions out of the range of the present invention are produced under the optimum production conditions but are inferior to the examples of the present invention in any one of the strength, toughness, and corrosion resistance of the maximum stress producing site of the arm portion of the automotive underbody part.

In Comparative Example 32, the Mg content is excessively low, while in Comparative Example 18, the Mg content is excessively high. In Comparative Example 33, the Si content is excessively low, while in Comparative Example 20, the Si content is excessively high. In Comparative Example 34, the Cu content is excessively low, while in Comparative Example 22, the Cu content is excessively high. In Comparative Example 23, the Fe content is excessively low, while in Comparative Example 24, the Fe content is excessively high. In Comparative Example 35, the Mn content is excessively low, while in Comparative Example 36, the Mn content is excessively high. In Comparative Example 37, the Cr content is excessively low, while in Comparative Example 28, the Cr content is excessively high. In Comparative Example 29, the Zr content is excessively high. In Comparative Example 38, the Ti content is excessively low, while in Comparative Example 31, the Ti content is excessively high.

These results indicate the critical meanings of the composition, optimum production conditions, and structure definitions of the present invention, for improving the strength, roughness, and corrosion resistance of the maximum stress producing site of an arm portion of an automotive underbody part.

TABLE 1

| | Al alloy | Al alloy chemical component (% by mass, balance including Al and inevitable impurities) | | | | | | | | |
|---|---|---|---|---|---|---|---|---|---|---|
| Section | No. | Mg | Si | Cu | Fe | Mn | Cr | Zr | Ti | Remarks |
| This invention example | A | 0.75 | 0.85 | 0.20 | 0.15 | 0.30 | 0.15 | 0.10 | 0.02 | |
| This invention example | B | 0.90 | 1.00 | 0.40 | 0.25 | 0.45 | 0.20 | 0.03 | 0.05 | |
| This invention example | C | 1.10 | 1.25 | 0.55 | 0.35 | 0.50 | 0.25 | 0.10 | 0.08 | |
| This invention example | D | 0.60 | 1.00 | 0.40 | 0.25 | 0.45 | 0.20 | 0.03 | 0.05 | Slightly little Mg |
| Comparative example | E | 1.30 | 1.00 | 0.40 | 0.25 | 0.45 | 0.20 | 0.03 | 0.05 | Excessive Mg |
| This invention example | F | 0.90 | 0.70 | 0.40 | 0.25 | 0.45 | 0.20 | 0.03 | 0.05 | Slightly little Si |
| Comparative example | G | 0.90 | 1.42 | 0.40 | 0.25 | 0.45 | 0.20 | 0.03 | 0.05 | Excessive Si |
| This invention example | H | 0.90 | 1.00 | 0.05 | 0.25 | 0.45 | 0.20 | 0.03 | 0.05 | Slightly little Cu |
| Comparative example | I | 0.90 | 1.00 | 0.72 | 0.25 | 0.45 | 0.20 | 0.03 | 0.05 | Excessive Cu |
| Comparative example | J | 0.90 | 1.00 | 0.40 | 0.02 | 0.45 | 0.20 | 0.03 | 0.05 | Too little Fe |
| Comparative example | K | 0.90 | 1.00 | 0.40 | 0.50 | 0.45 | 0.20 | 0.03 | 0.05 | Excessive Fe |
| This invention example | L | 0.90 | 1.00 | 0.40 | 0.25 | 0.10 | 0.20 | 0.03 | 0.05 | Slightly little Mn |
| This invention example | M | 0.90 | 1.00 | 0.40 | 0.25 | 0.70 | 0.20 | 0.03 | 0.05 | Slightly much Mn |
| This invention example | N | 0.90 | 1.00 | 0.40 | 0.25 | 0.45 | 0.05 | 0.03 | 0.05 | Slightly little Cr |

TABLE 1-continued

| Section | Al alloy No. | Al alloy chemical component (% by mass, balance including Al and inevitable impurities) Mg | Si | Cu | Fe | Mn | Cr | Zr | Ti | Remarks |
|---|---|---|---|---|---|---|---|---|---|---|
| Comparative example | O | 0.90 | 1.00 | 0.40 | 0.25 | 0.45 | 0.38 | 0.03 | 0.05 | Excessive Cr |
| Comparative example | P | 0.90 | 1.00 | 0.40 | 0.25 | 0.45 | 0.20 | 0.20 | 0.05 | Excessive Zr |
| This invention example | Q | 0.90 | 1.00 | 0.40 | 0.25 | 0.45 | 0.20 | 0.03 | 0.005 | Slightly little Ti |
| Comparative example | R | 0.90 | 1.00 | 0.40 | 0.25 | 0.45 | 0.20 | 0.03 | 0.15 | Excessive Ti |
| Comparative example | S | 0.40 | 1.00 | 0.40 | 0.25 | 0.45 | 0.20 | 0.03 | 0.05 | Too little Mg |
| Comparative example | T | 0.90 | 0.30 | 0.40 | 0.25 | 0.45 | 0.20 | 0.03 | 0.05 | Too little Si |
| Comparative example | U | 0.90 | 1.00 | — | 0.25 | 0.45 | 0.20 | 0.03 | 0.05 | Too little Cu |
| Comparative example | V | 0.90 | 1.00 | 0.40 | 0.25 | — | 0.20 | 0.03 | 0.05 | Too little Mn |
| Comparative example | W | 0.90 | 1.00 | 0.40 | 0.25 | 1.10 | 0.20 | 0.03 | 0.05 | Excessive Mn |
| Comparative example | X | 0.90 | 1.00 | 0.40 | 0.25 | 0.45 | — | 0.03 | 0.05 | Too little Cr |
| Comparative example | Y | 0.90 | 1.00 | 0.40 | 0.25 | 0.45 | 0.20 | 0.03 | — | Too little Ti |

TALE 2

| Section | No. | Al alloy No. | Casting cooling rate ° C./s | Homogenizing heat treatment condition Heating rate ° C./hr | Retention temp. ° C. | Retention time hr | Cooling rate ° C./hr | Hot forging finish temp. ° C. |
|---|---|---|---|---|---|---|---|---|
| This invention example | 1 | A | 150 | 200 | 520 | 4 | 100 | 400 |
| This invention example | 2 | B | 150 | 200 | 490 | 10 | 100 | 420 |
| This invention example | 3 | C | 150 | 200 | 510 | 4 | 100 | 370 |
| Comparative example | 4 | B | 80 | 200 | 500 | 4 | 100 | 370 |
| Comparative example | 5 | B | 150 | 200 | 450 | 4 | 100 | 370 |
| This invention example | 6 | B | 150 | 200 | 550 | 4 | 100 | 370 |
| This invention example | 7 | B | 150 | 10 | 500 | 4 | 100 | 370 |
| This invention example | 8 | B | 150 | 1200 | 500 | 4 | 100 | 370 |
| Comparative example | 9 | B | 150 | 200 | 500 | 4 | 20 | 370 |
| Comparative example | 10 | B | 150 | 200 | 500 | 4 | 100 | 370 |
| Comparative example | 11 | B | 150 | 200 | 500 | 4 | 100 | 370 |
| Comparative example | 12 | B | 150 | 200 | 500 | 4 | 100 | 370 |
| Comparative example | 13 | B | 150 | 200 | 500 | 4 | 100 | 370 |
| Comparative example | 14 | B | 150 | 200 | 580 | — | — | — |
| Comparative example | 15 | B | 150 | 5 | 500 | 4 | 100 | 370 |
| Comparative example | 16 | B | 150 | 1700 | 500 | 4 | 100 | 370 |

| Section | Solution treatment and hardening condition Retention temp. ° C. | Retention time hr | Cooling rate ° C./s | Age hardening condition Retention temp. ° C. | Retention time hr | Remarks (forging condition) (alloy composition) |
|---|---|---|---|---|---|---|
| This invention example | 555 | 3 | 300 | 190 | 2 | Within the invention range |
| This invention example | 560 | 3 | 250 | 190 | 5 | Within the invention range |
| This invention example | 545 | 3 | 200 | 180 | 10 | Within the invention range |
| Comparative example | 550 | 3 | 200 | 190 | 5 | Excessively low casting cooling rate |
| Comparative example | 550 | 3 | 200 | 190 | 5 | Excessively low soaking temperature |

TALE 2-continued

| | | | | | | |
|---|---|---|---|---|---|---|
| This invention example | 550 | 3 | 200 | 190 | 5 | Slightly high soaking temperature |
| This invention example | 550 | 3 | 200 | 190 | 5 | Slightly low soaking heating rate |
| This invention example | 550 | 3 | 200 | 190 | 5 | Slightly high soaking heating rate |
| Comparative example | 550 | 3 | 200 | 190 | 5 | Excessively low soaking cooling rate |
| Comparative example | 550 | 3 | 200 | 190 | 5 | Excessively low forging finish temperature |
| Comparative example | 535 | 3 | 200 | 190 | 5 | Excessively low solution treatment temperature |
| Comparative example | 565 | 3 | 200 | 190 | 5 | Excessively high solution treatment temperature |
| Comparative example | 540 | 2 | 20 | 190 | 5 | Excessively low hardening cooling rate |
| Comparative example | — | — | — | — | — | Excessively high soaking temperature |
| Comparative example | 540 | 2 | 200 | 190 | 5 | Excessively low soaking heating rate |
| Comparative example | 540 | 2 | 200 | 190 | 5 | Excessively high soaking heating rate |

TABLE 3

| | | | Casting | Homogenizing heat treatment condition | | | | |
|---|---|---|---|---|---|---|---|---|
| Section | No. | Al alloy No. | cooling rate ° C./s | Heating rate ° C./hr | Retention temp. ° C. | Retention time hr | Cooling rate ° C./hr | Hot forging finish temp. ° C. |
| This invention example | 17 | D | 150 | 200 | 500 | 4 | 100 | 400 |
| Comparative example | 18 | E | 150 | 200 | 500 | 4 | 100 | 400 |
| This invention example | 19 | F | 150 | 200 | 500 | 4 | 100 | 400 |
| Comparative example | 20 | G | 150 | 200 | 500 | 4 | 100 | 400 |
| This invention example | 21 | H | 150 | 200 | 500 | 4 | 100 | 400 |
| Comparative example | 22 | I | 150 | 200 | 500 | 4 | 100 | 400 |
| Comparative example | 23 | J | 150 | 200 | 500 | 4 | 100 | 400 |
| Comparative example | 24 | K | 150 | 200 | 500 | 4 | 100 | 400 |
| This invention example | 25 | L | 150 | 200 | 500 | 4 | 100 | 400 |
| This invention example | 26 | M | 150 | 200 | 500 | 4 | 100 | 400 |
| This invention example | 27 | N | 150 | 200 | 500 | 4 | 100 | 400 |
| Comparative example | 28 | O | 150 | 200 | 500 | 4 | 100 | 400 |
| Comparative example | 29 | P | 150 | 200 | 500 | 4 | 100 | 400 |
| This invention example | 30 | Q | 150 | 200 | 500 | 4 | 100 | 400 |
| Comparative example | 31 | R | 150 | 200 | 500 | 4 | 100 | 400 |
| Comparative example | 32 | S | 150 | 200 | 500 | 4 | 100 | 400 |
| Comparative example | 33 | T | 150 | 200 | 500 | 4 | 100 | 400 |
| Comparative example | 34 | U | 150 | 200 | 500 | 4 | 100 | 400 |
| Comparative example | 35 | V | 150 | 200 | 500 | 4 | 100 | 400 |
| Comparative example | 36 | W | 150 | 200 | 500 | 4 | 100 | 400 |

TABLE 3-continued

| | | | | | | | | |
|---|---|---|---|---|---|---|---|---|
| Comparative example | 37 | X | 150 | 200 | 500 | 4 | 100 | 400 |
| Comparative example | 38 | Y | 150 | 200 | 500 | 4 | 100 | 400 |

| | Solution treatment and hardening condition | | | Age hardening condition | | |
|---|---|---|---|---|---|---|
| Section | Retention temp. ° C. | Retention time hr | Cooling rate ° C./s | Retention temp. ° C. | Retention time hr | Remarks (forging condition) (alloy composition) |
| This invention example | 555 | 3 | 200 | 190 | 5 | Slightly little Mg |
| Comparative example | 555 | 3 | 200 | 190 | 5 | Excessive Mg |
| This invention example | 555 | 3 | 200 | 190 | 5 | Slightly little Si |
| Comparative example | 555 | 3 | 200 | 190 | 5 | Excessive Si |
| This invention example | 555 | 3 | 200 | 190 | 5 | Slightly little Cu |
| Comparative example | 555 | 3 | 200 | 190 | 5 | Excessive Cu |
| Comparative example | 555 | 3 | 200 | 190 | 5 | Excessively little Fe |
| Comparative example | 555 | 3 | 200 | 190 | 5 | Excessive Fe |
| This invention example | 555 | 3 | 200 | 190 | 5 | Slightly little Mn |
| This invention example | 555 | 3 | 200 | 190 | 5 | Slightly much Mn |
| This invention example | 555 | 3 | 200 | 190 | 5 | Slightly little Cr |
| Comparative example | 555 | 3 | 200 | 190 | 5 | Excessive Cr |
| Comparative example | 555 | 3 | 200 | 190 | 5 | Excessive Zr |
| This invention example | 555 | 3 | 200 | 190 | 5 | Slightly little Ti |
| Comparative example | 555 | 3 | 200 | 190 | 5 | Excessive Ti |
| Comparative example | 555 | 3 | 200 | 190 | 5 | Excessively little Mg |
| Comparative example | 555 | 3 | 200 | 190 | 5 | Excessively little Si |
| Comparative example | 555 | 3 | 200 | 190 | 5 | Excessively little Cu |
| Comparative example | 555 | 3 | 200 | 190 | 5 | Excessively little Mn |
| Comparative example | 555 | 3 | 200 | 190 | 5 | Excessive Mn |
| Comparative example | 555 | 3 | 200 | 190 | 5 | Excessively little Cr |
| Comparative example | 555 | 3 | 200 | 190 | 5 | Excessively little Ti |

TABLE 4

(continued from Table 2)

| | | | Rib structure and rib properties in maximum stress producing site of arm (after T6 treatment) | | | | | | | |
|---|---|---|---|---|---|---|---|---|---|---|
| | | | Re-crystallization | Crystal | Grain boundary | Dispersed particles | | Tensile properties 0.2% | | |
| Section | No. | Al alloy No. | average area ratio % | average area ratio % | precipitate average spacing μm | Average diameter Å | Average area ratio % | Tensile strength MPa | Yield strength MPa | Elongation % |
| This invention example | 1 | A | 8 | 0.6 | 4.0 | 1150 | 5 | 405 | 380 | 15 |

TABLE 4-continued (continued from Table 2)

| | | | | | | | | | | |
|---|---|---|---|---|---|---|---|---|---|---|
| This invention example | 2 | B | 5 | 0.8 | 2.0 | 1000 | 4 | 430 | 405 | 17 |
| This invention example | 3 | C | 6 | 0.2 | 3.0 | 1100 | 6 | 440 | 410 | 16 |
| Comparative example | 4 | B | 100 | 2.1 | 3.0 | 800 | 2 | 380 | 365 | 10 |
| Comparative example | 5 | B | 5 | 1.8 | 3.0 | 500 | 2 | 390 | 360 | 13 |
| This invention example | 6 | B | 85 | 0.6 | 1.5 | 2500 | 4 | 415 | 395 | 15 |
| This invention example | 7 | B | 70 | 0.8 | 3.0 | 1800 | 4 | 420 | 400 | 15 |
| This invention example | 8 | B | 85 | 0.8 | 1.5 | 1300 | 5 | 395 | 375 | 11 |
| Comparative example | 9 | B | 70 | 0.9 | 2.0 | 2000 | 5 | 405 | 385 | 12 |
| Comparative example | 10 | B | 100 | 0.7 | 1.5 | 1100 | 6 | 390 | 365 | 15 |
| Comparative example | 11 | B | 5 | 1.0 | 0.8 | 900 | 5 | 395 | 375 | 13 |
| Comparative example | 12 | B | 6 | 0.7 | 1.0 | 1300 | 4 | 420 | 385 | 15 |
| Comparative example | 13 | B | 5 | 1.5 | 0.5 | 900 | 5 | 355 | 335 | 15 |
| Comparative example | 14 | B | — | — | — | — | — | — | — | — |
| Comparative example | 15 | B | 10 | 1.6 | 0.5 | 2600 | 7 | 405 | 385 | 12 |
| Comparative example | 16 | B | 100 | 0.7 | 2.1 | 2500 | 2 | 410 | 390 | 15 |

| | Rib structure and rib properties in maximum stress producing site of arm (after T6 treatment) | | | Structure and properties of adjacent web | |
|---|---|---|---|---|---|
| Section | Charpy Impact value J/cm$^2$ | Inter-granular corrosion | Resistance to stress corrosion cracking hr | Re-crystallization average area ratio % | Tensile strength MPa |
| This invention example | 20 | ○ | 250 | 15 | 400 |
| This invention example | 16 | ○ | 250 | 10 | 410 |
| This invention example | 18 | ○ | 210 | 12 | 405 |
| Comparative example | 8 | X | 200 | 100 | 370 |
| Comparative example | 10 | X | 180 | 10 | 330 |
| This invention example | 18 | ○ | 100 | 90 | 375 |
| This invention example | 13 | ○ | 150 | 80 | 400 |
| This invention example | 10 | ○ | 150 | 90 | 390 |
| Comparative example | 10 | X | 150 | 85 | 380 |
| Comparative example | 10 | X | 130 | 100 | 350 |
| Comparative example | 15 | X | 230 | 10 | 375 |
| Comparative example | 13 | X | 190 | 12 | 410 |

TABLE 4-continued (continued from Table 2)

| | | | | | |
|---|---|---|---|---|---|
| Comparative example | 13 | X | 190 | 11 | 330 |
| Comparative example | — | — | — | — | — |
| Comparative example | 12 | X | 250 | 5 | 400 |
| Comparative example | 13 | X | 110 | 100 | 405 |

TABLE 4

(continued from Table 3)

| | | | Rib structure and rib properties in maximum stress producing site of arm (after T6 treatment) | | | | | | | |
|---|---|---|---|---|---|---|---|---|---|---|
| | | | Re-crystallization | Crystal | Grain boundary | Dispersed particles | | Tensile properties 0.2% | | |
| Section | No. | Al alloy No. | average area ratio % | average area ratio % | precipitate average spacing μm | Average diameter | Average area ratio % | Tensile strength MPa | Yield strength MPa | Elongation % |
| This invention example | 17 | D | 50 | 0.5 | 5.0 | 1100 | 5 | 375 | 350 | 18 |
| Comparative example | 18 | E | 65 | 1.8 | 1.0 | 800 | 4 | 420 | 400 | 13 |
| This invention example | 19 | F | 100 | 0.6 | 3.0 | 800 | 2 | 355 | 320 | 20 |
| Comparative example | 20 | G | 50 | 1.5 | 0.9 | 1100 | 5 | 425 | 405 | 12 |
| This invention example | 21 | H | 60 | 0.6 | 3.0 | 900 | 4 | 390 | 365 | 15 |
| Comparative example | 22 | I | 60 | 1.5 | 0.9 | 1100 | 5 | 430 | 415 | 13 |
| Comparative example | 23 | J | 100 | 0.3 | 1.2 | 700 | 2 | 415 | 390 | 15 |
| Comparative example | 24 | K | 50 | 1.8 | 0.9 | 1200 | 5 | 390 | 375 | 10 |
| This invention example | 25 | L | 100 | 0.5 | 1.2 | 700 | 2 | 405 | 385 | 15 |
| This invention example | 26 | M | 60 | 1.5 | 0.7 | 1300 | 5 | 395 | 375 | 10 |
| This invention example | 27 | N | 100 | 0.6 | 1.5 | 900 | 2 | 415 | 395 | 15 |
| Comparative example | 28 | O | 40 | 2.1 | 0.8 | 1500 | 4 | 405 | 380 | 13 |
| Comparative example | 29 | P | 60 | 0.8 | 0.9 | 1000 | 4 | 420 | 395 | 15 |
| This invention example | 30 | Q | 20 | 0.7 | 2.0 | 1100 | 5 | 410 | 390 | 17 |
| Comparative example | 31 | R | 50 | 1.3 | 0.7 | 1100 | 4 | 390 | 370 | 12 |
| Comparative example | 32 | S | 50 | 0.4 | 6.0 | 1300 | 6 | 365 | 340 | 19 |
| Comparative example | 33 | T | 65 | 0.3 | 8.0 | 800 | 3 | 280 | 250 | 25 |
| Comparative example | 34 | U | 15 | 0.6 | 3.0 | 800 | 3 | 380 | 360 | 19 |
| Comparative example | 35 | V | 100 | 0.1 | 4.0 | 300 | 1 | 345 | 330 | 22 |
| Comparative example | 36 | W | 3 | 3.5 | 1.0 | 2700 | 7 | 385 | 370 | 12 |
| Comparative example | 37 | X | 30 | 0.6 | 2.2 | 1300 | 3 | 398 | 380 | 15 |

TABLE 4-continued (continued from Table 3)

| | | | | | | | | | | |
|---|---|---|---|---|---|---|---|---|---|---|
| Comparative example | 38 | Y | 12 | 0.6 | 2.0 | 1000 | 4 | 420 | 420 | 18 |

| | | Rib structure and rib properties in maximum stress producing site of arm (after T6 treatment) | | | Structure and properties of adjacent web | |
|---|---|---|---|---|---|---|
| | Section | Charpy Impact value J/cm$^2$ | Inter-granular corrosion | Resistance to stress corrosion cracking hr | Re-crystallization average area ratio % | Tensile strength MPa |
| | This invention example | 15 | ○ | 230 | 65 | 355 |
| | Comparative example | 10 | X | 150 | 75 | 405 |
| | This invention example | 20 | ○ | 250 | 100 | 340 |
| | Comparative example | 10 | X | 100 | 60 | 400 |
| | This invention example | 17 | ○ | 250 | 75 | 365 |
| | Comparative example | 10 | X | 100 | 70 | 410 |
| | Comparative example | 18 | X | 150 | 100 | 390 |
| | Comparative example | 11 | X | 130 | 65 | 370 |
| | This invention example | 18 | ○ | 130 | 100 | 390 |
| | This invention example | 10 | ○ | 150 | 75 | 375 |
| | This invention example | 13 | ○ | 180 | 100 | 395 |
| | Comparative example | 11 | X | 150 | 65 | 390 |
| | Comparative example | 13 | X | 180 | 80 | 400 |
| | This invention example | 17 | ○ | 200 | 30 | 380 |
| | Comparative example | 11 | X | 200 | 70 | 365 |
| | Comparative example | 17 | X | 50 | 88 | 355 |
| | Comparative example | 22 | X | 100 | 75 | 275 |
| | Comparative example | 18 | X | 180 | 10 | 370 |
| | Comparative example | 20 | X | 5 | 100 | 350 |
| | Comparative example | 10 | X | 100 | 8 | 380 |
| | Comparative example | 14 | X | 120 | 20 | 385 |
| | Comparative example | 17 | X | 180 | 20 | 410 |

INDUSTRIAL APPLICABILITY

According to the present invention, it is possible to provide an automotive underbody part having higher strength, higher toughness, and higher corrosion resistance and a method of producing the automotive underbody part. Therefore, the present invention has a high industrial value from the viewpoint that it can extend the application of Al—Mg—Si aluminum alloy forging materials to transports (e.g., various structural members of automobiles).

The invention clamed is:

1. An aluminum alloy forging material comprising an arm portion comprising, by % by mass, 0.5 to 1.25% of Mg, 0.4 to 1.4% of Si, 0.01 to 0.7% of Cu, 0.05 to 0.4% of Fe, 0.001 to 1.0% of Mn, 0.01 to 0.35% of Cr, 0.005 to 0.1% of Ti, Zr controlled to less than 0.15%, and the balance being Al and inevitable impurities, the material having a substantially H-shaped width-direction sectional form comprising a relatively narrow and thick peripheral rib and a relatively wide central web, wherein in a width-direction sectional structure in a maximum stress producing site of the rib, a density of crystals observed in the sectional structure in the maximum stress producing site is 1.5% or less in terms of an average area ratio, and an average spacing between grain boundary precipitates observed in the sectional structure comprising a parting line which is produced during forging, is 0.7 μm or more, and wherein in the width-direction sectional structure in the maximum stress producing site of the rib, a size of dispersed particles observed in the sectional structure in the maximum stress producing site is 1200 Å or less in terms of an average diameter, a density of the dispersed particles is 4% or more in terms of an average area ratio, an area ratio of recrystallized grains observed in the sectional structure of the rib is 10% or less in terms of an average area ratio, and the area ratio of recrystallized grains observed in a sectional structure of the web adjacent to the sectional structure of the rib in the width direction thereof is 20% or less in terms of an average area ratio.

2. The aluminum forging material according to claim 1, wherein the average area ratio of the crystals observed in the sectional structure of the maximum stress producing site is 1.0% or less, and the average spacing between the grain boundary precipitates observed in the sectional structure including the parting line which is produced during forging, is 1.6 μm or more.

3. The aluminum alloy forging material according to claim 1, wherein the composition comprises, by % by mass, 0.7 to 1.25% of Mg, 0.8to 1.3% of Si, 0.1 to 0.6% of Cu, 0.1 to 0.4% of Fe, 0.2 to 0.6% of Mn, 0.1 to 0.3% of Cr, 0.01 to 0.1% of Ti, Zr controlled to less than 0.15%, and the balance being Al and inevitable impurities.

4. The aluminum alloy forging material according to claim 1, wherein the composition comprises, by % by mass, 0.9 to 1.1% of Mg, 0.9 to 1.1% of Si, 0.3 to 0.5% of Cu, 0.1 to 0.4% of Fe, 0.2 to 0.6% of Mn, 0.1 to 0.2% of Cr, 0.01 to 0.1% of Ti, Zr controlled to less than 0.15%, and the balance being Al and inevitable impurities.

5. The aluminum alloy forging material according to claim 1, wherein a thickness of the web is 10 mm or less.

6. The aluminum alloy forging material according to claim 1, wherein a crystal grain size of the material is 10 μm or less.

7. The aluminum alloy forging material according to claim 1, wherein a corrosion depth of the material is 200 μm or less.

8. The aluminum alloy forging material according to claim 1, wherein the material is made by a process comprising:

casting at an average cooling rate of 100° C/s or more an aluminum alloy melt having a composition comprising, by % by mass, 0.5 to 1.25% of Mg, 0.4 to 1.4% of Si, 0.01 to 0.7% of Cu, 0.05 to 0.4% of Fe, 0.001 to 1.0% of Mn, 0.01 to 0.35% of Cr, 0.005 to 0.1% of Ti, Zr controlled to less than 0.15%, and the balance being Al and inevitable impurities;

homogenizing the cast ingot by heating in a temperature range of 460° C. to 570° C. at a heating rate of 10 to 1500° C/hr and maintaining the ingot in the temperature range for 2 hours or more;

cooling the ingot to room temperature at a cooling rate of 40° C/hr or more;

reheating the ingot to a hot-forging start temperature; performing hot die-forging to form an aluminum alloy forging material comprising an arm portion which has a substantially H-shaped width-direction sectional form and which comprises a relatively narrow and thick peripheral rib and a relatively wide central web, wherein a forging finish temperature is 350° C. or more;

performing solution treatment by maintaining the material in the temperature range of 530° C. to 570° C. for 20 minutes to 8 hours;

hardening the material at an average cooling rate in the range of 200 to 300° C/s; and performing artificial age hardening.

9. The aluminum alloy forging material according to claim 8, wherein a corrosion depth of the material is 200 μm or less.

10. The aluminum alloy forging material according to claim 1, comprising Si of 0.9 to 1.1%, Mn of 0.2 to 0.6% and Cr of 0.1 to 0.2% by % by mass.

11. The aluminum alloy forging material according to claim 1, comprising Cu of 0.1 to 0.7% by % by mass.

12. The aluminum alloy forging material according to claim 1, comprising Zr less than 0.05% by % by mass.

13. The aluminum alloy forging material according to claim 1, wherein the crystals are Al—Fe—Si crystals.

14. The aluminum alloy forging material according to claim 1, comprising dispersed particles comprising one or more of Al—Mn, Al—Cr and Al—Zr intermetallic compounds.

15. The aluminum alloy forging material according to claim 1, wherein an average maximum diameter of $Mg_2Si$ grain boundary precipitates is 2 μm or less.

16. The aluminum alloy forging material according to claim 8, comprising homogenizing the cast ingot by heating in a temperature range of 460° C. to 570° C. at a heating rate of 20 to 1500° C/hr.

17. The aluminum alloy forging material according to claim 1, wherein the material has a resistance time to stress corrosion cracking of more than 200 hrs.

18. The aluminum alloy forging material according to claim 1, wherein the material has a resistance time to stress corrosion cracking of from 210 hrs to 250 hrs.

19. A method for producing the aluminum alloy forging material according to claim 1 comprising:

casting at an average cooling rate of 100° C/s or more an aluminum alloy melt having a composition comprising, by % by mass, 0.5 to 1.25% of Mg, 0.4 to 1.4% of Si, 0.01 to 0.7% of Cu, 0.05 to 0.4% of Fe, 0.001 to 1.0% of Mn, 0.01 to 0.35% of Cr, 0.005 to 0.1% of Ti, Zr controlled to less than 0.15%, and the balance being Al and inevitable impurities;

homogenizing the cast ingot by heating in a temperature range of 460° C. to 570° C. at a heating rate of 10 to 1500° C/hr and maintaining the ingot in the temperature range for 2hours or more;

cooling the ingot to room temperature at a cooling rate of 40° C/hr or more;

reheating the ingot to a hot-forging start temperature; performing hot die-forging to form an aluminum alloy forging material comprising an arm portion which has a substantially H-shaped width-direction sectional form and which comprises a relatively narrow and thick peripheral rib and a relatively wide central web, wherein a forging finish temperature is 350° C. or more;

performing solution treatment by maintaining the material in the temperature range of 530° C. to 570° C. for 20 minutes to 8 hours;

hardening the material at an average cooling rate in the range of 200 to 300° C/s; and performing artificial age hardening.

* * * * *